United States Patent [19]

Jordá

[11] Patent Number: 4,932,790

[45] Date of Patent: Jun. 12, 1990

[54] CLOSURE DEVICE FOR AN EXTRUDED PLASTICS NET BAG

[75] Inventor: José M. Jordá, Cardedeu, Spain

[73] Assignee: Intermas, S.A., Barcelona, Spain

[21] Appl. No.: 199,950

[22] Filed: May 26, 1988

[30] Foreign Application Priority Data

Jul. 13, 1987 [ES] Spain ..... 8702328

[51] Int. Cl.[5] ..... B65D 30/06; B65D 33/28

[52] U.S. Cl. ..... 383/74; 24/18; 24/30.5 T; 24/115 H; 383/76

[58] Field of Search ..... 383/74, 76; 24/30.5 R, 24/129 C, 131 R, 129 B, 115 C, 115 H, 266

[56] References Cited

U.S. PATENT DOCUMENTS

| | | | |
|---|---|---|---|
| 2,253,688 | 8/1941 | Collins | 383/76 |
| 2,392,221 | 1/1946 | Brady | 24/266 |
| 2,593,334 | 5/1952 | Ahlburg | 383/74 |
| 2,641,808 | 6/1953 | Tinnerman | 24/18 |
| 2,832,116 | 4/1958 | Clevett, Jr. et al. | 24/115 H |
| 3,426,393 | 2/1969 | Mead | 24/30.5 T |
| 4,573,204 | 2/1986 | Polett | 383/74 |

*Primary Examiner*—Stephen P. Garbe

*Attorney, Agent, or Firm*—Bell, Seltzer, Park & Gibson

[57] ABSTRACT

In the proximity of the mouth of the bag there is disposed a filiform closing member which is threaded through interstices of the net material and is provided with two ends extending laterally outwardly of the bag. The ends are attached together with a short tape fastener member wrapping a portion of each end and capable of sliding along the ends.

4 Claims, 2 Drawing Sheets

FIG. 3
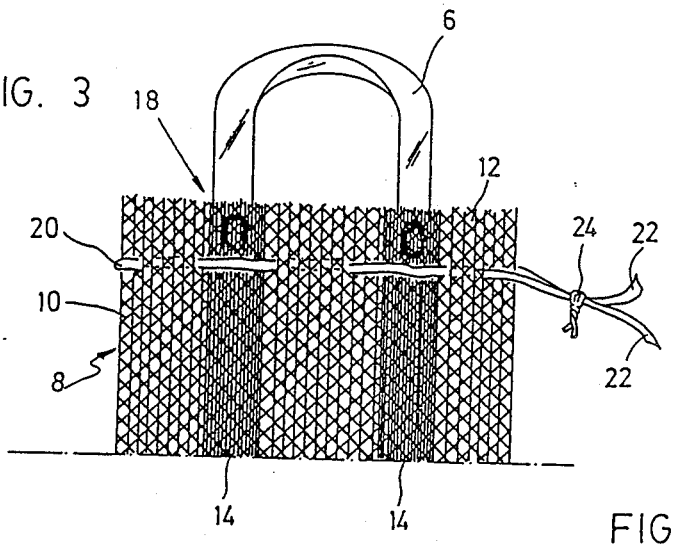
FIG. 5
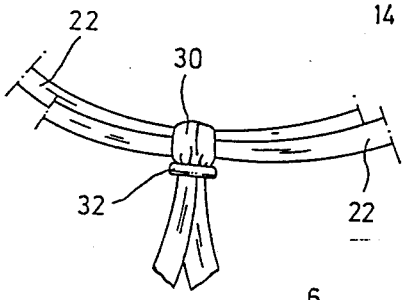
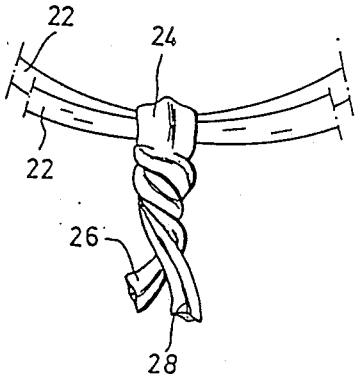
FIG. 6
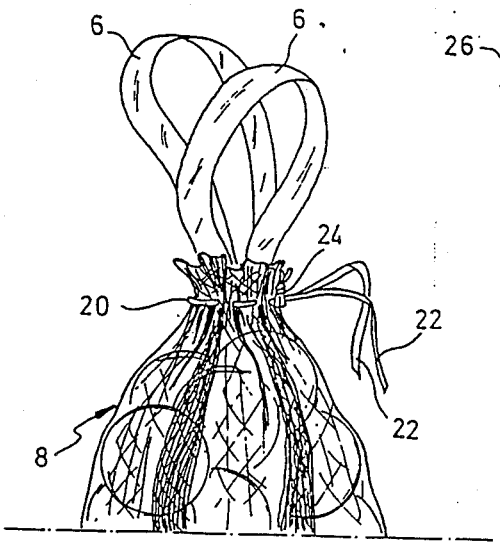
FIG. 4

CLOSURE DEVICE FOR AN EXTRUDED PLASTICS NET BAG

BACKGROUND OF THE INVENTION

This invention relates to a closure device for an extruded plastics net bag having interstices, said bag having a width and being provided with a mouth in the proximity of which there is a filiform closing member embracing the whole width of the bag, passing through the net material by being threaded through the interstices thereof, said filiform member having two ends extending laterally outwardly from the bag.

DESCRIPTION OF THE PRIOR ART

The use of bags for the delivery and sale of fruit, particularly of the so-called "citrus fruits", namely, oranges and lemons, is on the increase.

There is a wide variety of types of bag on the market. As stated above, the invention relates to bags formed by an extruded plastics net material which, in comparison with bags formed by sheet-like plastics material, afford, among others, the advantage of providing a better aeration of the fruit contained therein.

Such extruded plastics net bags are manufactured in a completely mechanical and automated form, usually starting out from a reel of tubular material, which is successively die-cut and welded to provide the final form, or such final form is obtained when applying, also mechanically, other items such as the handles (in certain cases).

The bags are usually acquired by wholesalers or exporters who fill the bags with fruit and then have to close the bags. It is obvious that, on the one hand, the closure has to be effective, also has to be simple to effect and, finally, on the other hand should not involve high costs attributable to the bag manufacturing process.

One type of closure is to provide the bag with flaps on either side of the mouth, said flaps being capable of being knotted together to close the bag mouth.

In other cases, as contemplated herein, the bags are provided with a tape, cord, thread or, in general, a filiform member located close to the mouth and which is held in place by being threaded through various interstices of the net material. Once the bag is full, the tape or the like is capable of throttling the bag mouth and, therefore, closing it, it being necessary to ensure that it stays closed by tying a knot with the two ends of the tape.

The mounting of the filiform member to the bag during the manufacturing process thereof has recently been achieved by mechanical means, whereby such mounting does not represent an interruption of the mass production process nor does it involve the need for manual operations.

The throttling operation has been facilitated by the inclusion of a button like member through which the two ends of the filiform member are threaded. Nevertheless, the mounting of the button of necessity requires a manual operation, whereby the mass production process is interrupted and the cost of the bag is made more expensive.

SUMMARY OF THE INVENTION

The closure device stated hereinbefore has been devised to overcome the aforementioned drawbacks and is characterised in that said ends are united together by a short tape fastener member which by twisting, folding or other means simultaneously tightly binds a portion of each end, allowing for sliding of the fastener member along the ends.

Preferably according to the invention said fastener member consist of a short tape provided with a wire core, which wraps said ends and is provided with mutually twisted end portions.

Said fastener member is applied to the bag by uncumbersome mechanical processes, whereby it improves on the system consisting of the use of the button like member, on not involving the need for manual operations.

BRIEF DESCRIPTION OF THE DRAWINGS

Further advantages of the invention will be disclosed in the following description which, without any limitation relates to a preferred embodiment of the invention, described with reference to the enclosed drawings, in which:

FIG. 3 is a partial view of a plastics net bag with a filiform member for closing the bag by throttling it, showing the reinforced fastener member of the invention.

FIG. 4 is a bag identical to the previous one, full of produce, with the mouth thereof closed by throttling.

FIG. 5 is a perspective view, on a larger scale, of the fastener member binding the ends of the filiform member.

FIG. 6 is a perspective view of a further embodiment of the fastener member.

DESCRIPTION OF THE PREFERRED EMBODIMENTS

Figure 1:
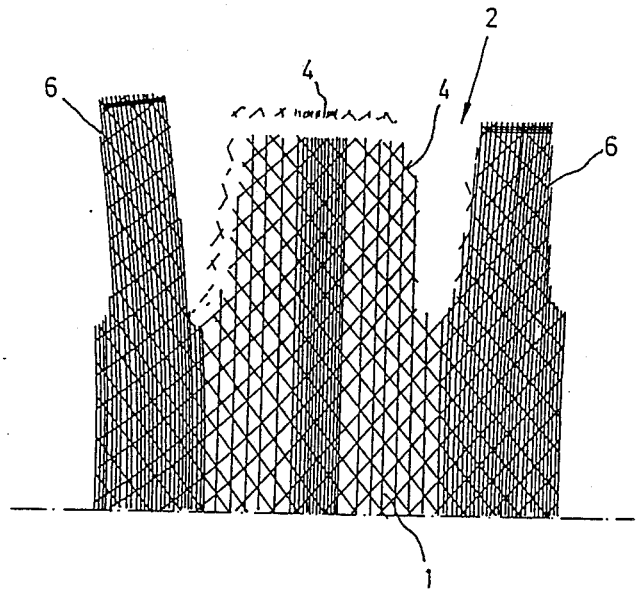
FIG. 1 is a partial view of a known net bag showing central flaps on both sides of the bag mouth.
Figure 2:
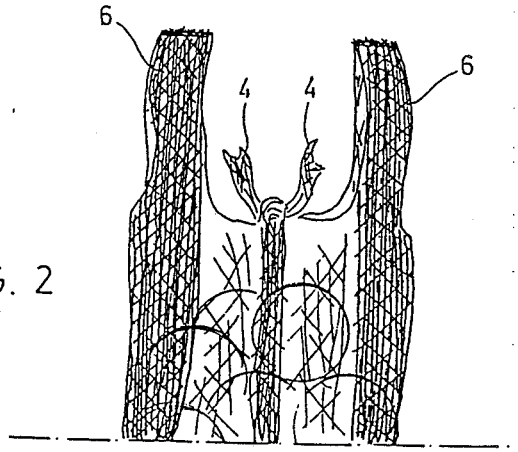
FIG. 2 is a bag identical to the above one, full of produce and with the mouth thereof closed by knotting the said centre flaps together.

FIGS. 1 and 2 show a known technique for closing the mouth of an extruded plastics net bag.

This technique, developed by the applicant hereof, describes a bag formed by a tubular body which, in flattened state, defines two sides 1 and two flaps 4 extend from the bag mouth 2, each one forming an extension of one of the sides 1. The bag is effectively closed when the flaps 4 are knotted together. In the illustrated example, the flaps 4 are disposed between the handles 6, each of which extends from one side 1 to the other of the bag.

FIG. 3 is a partial view of a bag 8, also formed from plastics net material and the mesh thereof is formed by two or more bundles of parallel strands 10 which, on crossing, form interstices 12. The bag may be provided with reinforced longitudinal web portions 14 which make the bag stronger. Preferably the handles 6 of the bag are attached to said web portions 14, so as to better adapt themselves to the stresses caused by the weight of the loaded bag.

The bag 8 is provided with a mouth 18 and in the proximity thereof there is a filiform member 20 passing through the net material on being threaded through the interstices thereof.

The filiform member may be formed by a cord, thread, tape or similar member of yarn, plastics or other appropriate material and extends laterally from the bag, having two ends 22.

The two ends 22 are attached together by a short tape fastener member 24 having a medial portion surrounding the ends 22, and opposed end portions. Means is provided for joining the opposed end portions of the short tape fastener member 24 together, such as by twisting, folding or other like means, to bind both ends 22 together in such a way as to allow the fastener member to slide along the two ends 22.

The reinforcing fastening member 24 may be formed by a short tape 26 of plastics material, provided with a wire core 28 (FIG. 5), which facilitates twisting together the opposed ends thereof around the ends 22.

In a further embodiment, a short tape fastening member 30 binds the ends 22 and a small ring 32 ensures the binding (FIG. 6).

To close the bag 8 after filling, the short tape fastener member 24, 30, is taken in one hand and the other hand pulls the ends 22. This closes the mouth 18 of the bag 8 by throttling it, the fastener member 24 being abutting the bag 8. Thereafter a bow (not shown) is formed with the ends 22, the closure being thus guaranteed.

In other known embodiments, instead of the fastener member 24, 30, there is used a small button like member which is provided with one or more holes through which the ends 22 are threaded and the bag is closed in the same way as mentioned above, namely, the button is held while the ends are pulled through, throttling the bag, which is held closed by tying a bow with the ends.

Nevertheless, there are important differences between the short tape fastener member of the invention and the prior art button. In the first place, when the bag mouth has been closed by throttling and the button is released to tie the bow, the throttling yields slightly, whereby it is more difficult and, in certain cases less effective to tie the bow thereafter. On the contrary, when the bag is throttled with the short tape fastener member 24, 30 of the invention, the fastener member is caused to bite into or be slightly entangled in the wrinkles that the throttling operation has caused in the net material, thereby preventing the throttling from yielding and thus it becomes easier to tie the bow subsequently with the ends 22 and the bow is more effective.

Nevertheless, the greatest difference between the abovementioned button and the fastener member 24, 30 described herein is that the present short tape fastener member may be applied to the bag mechanically, with the use of appropriate machinery. On the contrary, the said button has to be mounted of necessity by hand, threading the ends 22 through the button hole or holes. This manual operation involves a proportionately high use of labour which increases the price of the product to the extent, in certain cases, of notably affecting its competitivity.

What I claim is:

1. A closure device for an extruded plastics net bag having interstices, said bag having a width and being provided with a mouth in the proximity of which there is a filiform closing member embracing the whole width of the bag, passing through the net material by being threaded through the interstices thereof, said filiform member having two ends extending laterally outwardly from the bag, characterised in that said ends of said filiform member are united together by a fastener member comprising a short tape having a medial portion surrounding said ends of said filiform member and opposed end portions, and means joining said opposed end portions together and simultaneously tightly binding together a portion of each of said ends of said filiform member, allowing for sliding of said fastener member along said ends of said filiform member.

2. The device of claim 1, characterised in that said short tape fastener member includes a reinforcing wire core, and wherein said joining means comprises mutually twisted end portions of said short tape fastener member.

3. The device of claim 1, characterised in that said short tape fastener member is made from resilient plastic material.

4. The device of claim 1, characterised in that said joining means of said short tape fastener member consists of a small ring surrounding the opposed end portions of said short tape fastener member.

* * * * *